US012163424B2

(12) United States Patent
McClure

(10) Patent No.: US 12,163,424 B2
(45) Date of Patent: Dec. 10, 2024

(54) METHOD FOR INSTALLING AN EARTHING SYSTEM

(71) Applicant: Timothy Robert McClure, Castlemaine (AU)

(72) Inventor: Timothy Robert McClure, Castlemaine (AU)

( * ) Notice: Subject to any disclaimer, the term of this patent is extended or adjusted under 35 U.S.C. 154(b) by 0 days.

(21) Appl. No.: 18/034,860

(22) PCT Filed: Nov. 2, 2021

(86) PCT No.: PCT/AU2021/051290

§ 371 (c)(1),
(2) Date: May 1, 2023

(87) PCT Pub. No.: WO2022/087690

PCT Pub. Date: May 5, 2022

(65) Prior Publication Data

US 2024/0018830 A1 Jan. 18, 2024

(30) Foreign Application Priority Data

Nov. 2, 2020 (AU) ..... 2020903990
Aug. 25, 2021 (AU) ..... 2021902748

(51) Int. Cl.
*E21B 7/04* (2006.01)
*E21B 47/125* (2012.01)

(52) U.S. Cl.
CPC ..... *E21B 7/04* (2013.01); *E21B 47/125* (2020.05)

(58) Field of Classification Search
CPC ..... E21B 7/04; E21B 7/06; E21B 47/125
See application file for complete search history.

(56) References Cited

U.S. PATENT DOCUMENTS 4,786,874 A 11/1988 Grosso et al.
5,168,942 A 12/1992 Wydrinski
(Continued)

FOREIGN PATENT DOCUMENTS

AU 2016331657 A1 4/2018
CN 208111707 U 11/2018
(Continued)

OTHER PUBLICATIONS

International Search Report for PCT/AU2021/0511290, dated Jan. 24, 2022.
(Continued)

*Primary Examiner* — Dany E Akakpo
(74) *Attorney, Agent, or Firm* — McDonald Hopkins LLC

(57) ABSTRACT

The present invention relates to a method of installing an electrical earthing system, comprising: determining a borehole site, providing a drill string comprised of a conductive material and having a drill bit at an end thereof, and electrically connecting the drill string to an earth test terminal of a resistance testing apparatus, electrically connecting a test electrode or electrodes to a remaining terminal or terminals of the resistance testing apparatus and placing the test electrode(s) around the borehole, drilling the borehole using the drill string, periodically or continuously measuring and recording a total electrical resistance using the resistance testing apparatus, and adjusting the drill string to reduce the total electrical resistance towards a target total electrical resistance, removing the drill rod from the borehole and disconnecting the drill string from the resistance testing apparatus, installing an earthing electrode within the borehole, and backfilling the borehole with backfill ground material.

12 Claims, 12 Drawing Sheets

(56) References Cited

U.S. PATENT DOCUMENTS

| | | | | |
|---|---|---|---|---|
| 6,064,210 | A | 5/2000 | Sinclair | |
| 7,143,844 | B2 | 12/2006 | Alft et al. | |
| 2006/0011385 | A1 | 1/2006 | Seydoux et al. | |
| 2007/0205022 | A1 | 9/2007 | Treviranus et al. | |
| 2009/0178850 | A1* | 7/2009 | Waters | E21B 47/0228 175/45 |
| 2014/0102792 | A1* | 4/2014 | Lachner, Jr. | E21B 47/0232 175/45 |

FOREIGN PATENT DOCUMENTS

| | | | |
|---|---|---|---|
| EP | 0621488 | A1 | 10/1994 |
| RU | 2181918 | C2 | 4/2002 |
| WO | 2010/079888 | A2 | 7/2010 |
| WO | 2017054046 | A1 | 4/2017 |

OTHER PUBLICATIONS

Written Opinion of the International Searching Authority dated Jan. 24, 2022.

International-type search for provisional patent application AU 2020903990 dated Jun. 10, 2021.

"Earthing techniques. Soil resistivity testing." XP055131739, 2006, pp. 1-40, Retrieved from the Internet on Jul. 25, 2014: url:http://www.lightningman.com.au/earthing.pdf.

Extended European Search Report for Application 21884179.9, PCT/AU2021/051290 dated May 8, 2024, 8 pgs., European Patent Office, Germany.

* cited by examiner

METHOD FOR INSTALLING AN EARTHING SYSTEM

CROSS REFERENCE TO RELATED APPLICATIONS

This application a 371 National Stage Application of International Application No. PCT/AU2021/051920 filed on Nov. 2, 2021 which claims priority to Augstralian (AU) Application Serial No. 2020903990 filed on Nov. 2, 20220 and Australian (AU) Application Serial No. 2021902748 filed on Aug. 25, 2021, the contents of all or which are incorporated herein by reference in their entireties.

BACKGROUND OF THE INVENTION

Technical Field

The present invention relates generally to the field of earthing systems, and specifically relates to a method for installing earth grounding. In particular, the invention relates to the installation of earth grounding in directionally drilled bores.

Background

In an electrical installation, an earthing system connects specific parts of that installation with the Earth's conductive surface either for safety/protective or functional purposes. Every electrically conductive surface in a structure must be grounded. This is achieved by connecting these conductive surfaces to a grounding system, which includes a grounding wire (which is usually protected by a green insulation sheath) and moves throughout the building and terminates at an earth electrode. In some arrangements, electrical power or signals are commonly transmitted via a pair of wires providing a complete circuit, or via an electrical cable likewise containing (at least) two conductors for that purpose. However, in alternate arrangements the power or signals are transmitted via a single-wire transmission line (or single wire method), which uses only a single electrical conductor. One further way of transmitting electrical power or signals is via a single-wire earth return (SWER) or single-wire ground return. The distinguishing feature of SWER is that the earth (or sometimes a body of water) is used as the return path for the current, to avoid the need for a second wire (or neutral wire) to act as a return path. Earthing is therefore critical in a SWER installation. SWER is a single-wire transmission line, which supplies single-phase electric power from an electrical grid (particularly) to remote areas at low cost. As such, SWER is principally used for rural electrification, but is also deployed for other applications.

In simple installations, the earth electrode is a standard length of conductive copper in the form of a long metal spike, which binds all of these grounded parts to the soil so that any electrical discharges are channeled directly into the Earth. In these simple installations, the electrode is basically a metal spike that's hammered into the ground outside a home or other building. In other installations where more 'robust' solutions are required, typically a large pit or trench must be excavated. Within these pits or trenches, earthing plates, grounding rings and arrays of rods are utilised to ground the electrical circuits.

In either case, in order to be effective, the resistivity of the earthing electrode must be as close to zero ohms (On) as possible. This is because electrical discharges always take the path of least resistance, so to ensure an earthing electrode functions correctly it must provide said path of least resistance. Because significant currents (in the order of 8 amperes) can flow through the ground near the earth points, a good-quality earth connection is needed to prevent risk of electric shock due to earth potential rise near these earthing points. In order to correctly install the earthing electrode following a conventional approach, soil resistivity is assessed first, a bore, trench, channel or other suitable 'opening' in the ground is excavated, and then the electrode plates and/or rods are configured in the ground pit or channel. In some cases, it may also be necessary to add low resistance compounds into the ground pit or channel (such as bentonite) as back-fill, which helps lower soil resistivity. Once the electrode has been installed in the ground pit or channel, the threading ground wire is bonded to the electrode(s). The ground pit, channel or ditch can then be covered, either with back-fill soil and/or with other soil additives as discussed above.

The primary characteristic that affects functionality of a given earth electrode is the ground material surrounding the electrode. The ground is typically comprised of a mixture of ground material, such as soil, dirt, gravel, rocks, agglomerate, plant matter and other material types, often broadly arranged in pockets, strata or layers. As is shown in FIG. 1 (which is simplified for ease of understanding), the ground in which an electrode is installed for an earthing system may comprise a number of strata, or at the very least, different layers of ground material type, each of which may have approximately internally consistent characteristics that distinguish that particular stratum or layer from other distinct layers or strata. These layers are not necessarily horizontal with respect to the earth, and the interfaces between adjacent layers are not necessarily flat. Each 'layer' of ground material, having a particular composition, will have a resistivity, which is a measure of how much the ground material resists or conducts electric current. Importantly with respect to earthing systems, the resistivity of different strata layers can be different, and some layers may have favourable resistivity characteristics, whereas some layers may have unfavourable resistivity characteristics. Resistivity characteristics include the ground material type and composition, average ground temperature, moisture content, packing density (or conversely, aeration), each of which may either positively or negatively affect the ground material's resistance to flow of electricity therethrough. Where the resistivity of the soil is particularly high (which is not favourable for earthing systems), when following conventional installation methods, it may be necessary for the earthing system to incorporate multiple electrodes, or for the electrode to be of a substantial length (in some cases well over a hundred plus metres) in order to function effectively.

It can sometimes be beneficial for an earthing electrode to be installed horizontally. In these cases, the ground pit or channel that needs to be excavated may be over a few hundred metres in length in order for the electrode to be effective in grounding the electrical installation. This can be problematic as it can be difficult to keep such a ground pit or channel within designated easements and/or the ground pit or channel may destroy native vegetation or other cultural heritage areas. Similarly, pre-existing infrastructure may be in the way of any trenching or large-scale digging. In other words, there are often reasons why digging such a large/long trench can be problematic, meaning that horizontal installation of an earthing electrode using prior art methods is not always possible.

Therefore, it would be desirable for an alternate option to be provided. Given the time consuming process for expert electrical grounding fitters to prepare conventional earthing systems, and the drawbacks discussed above of such systems, there is a need to provide an alternate earthing system that overcomes, ameliorates or at least provides an alternative to prior art earthing systems.

DISCLOSURE OF THE INVENTION

In a first aspect, the present invention relates to a method of installing an electrical earthing system in a region of ground, comprising the steps of:

I. determining a borehole site in the region of ground;

II. providing a drill string comprised of a conductive material and having a drill bit at an end thereof, and electrically connecting the drill string to an earth test terminal of a resistance testing apparatus;

III. electrically connecting a test electrode or electrodes to a remaining terminal or terminals of the resistance testing apparatus and placing the test electrode or electrodes in or on the ground within an area around the borehole;

IV. drilling the borehole using the drill string;

V. periodically or continuously measuring and recording a total electrical resistance using the resistance testing apparatus, and adjusting the drill string to reduce the total electrical resistance towards a target total electrical resistance;

VI. removing the drill rod from the borehole and disconnecting the drill string from the resistance testing apparatus;

VII. installing an earthing electrode within the borehole; and

VIII. backfilling the borehole with backfill ground material;

wherein the total electrical resistance is electrical resistance measured between a submerged portion of the drill string and the test electrode or electrodes.

In an embodiment, if, by step (VI), the total electrical resistance does not reach the target total electrical resistance, steps (I)-(VI) are repeated to drill a further borehole in the region of ground, a further earthing electrode is installed within the further borehole, which is then backfilled with ground material, total electrical resistance is electrical resistance measured between each of a conductive element in the first borehole and a further conductive element in the further borehole and the test electrode or electrodes, the conductive element is either the earthing electrode installed within the electrode or the submerged portion of the drill string, depending on if Step (VII) is executed for the borehole, and the further conductive element is either a submerged portion of the drill string within the further borehole, or a submerged portion of a further drill string, depending on if Step (VII) is executed for the borehole.

In an embodiment, the step of determining the borehole site comprises using the resistance testing apparatus to test ground electrical resistance at a plurality of sites within the region, using the ground electrical resistance to identify, from the plurality of sites within the region, at least one qualifying site, and selecting the borehole site from the at least one qualifying site or sites, wherein the qualifying or sites are identified by having favourable resistivity characteristics relative to other sites of the plurality of sites. In an embodiment, the borehole site is selected as the site having the most favourable resistivity characteristics of the plurality of sites.

In an embodiment, the drill bit is a directional drill bit, and during Step (IV), a direction of the drill bit is adjustable such that the borehole is able to be drilled to comprise consecutive portions thereof extending non-parallel to one another. In an embodiment, the borehole extends through a ground layer at an angle between −45° and +45° relative to horizontal (0°) for at least a portion of a length thereof. In an embodiment, the borehole is drilled such that at least a portion of a length of the borehole extends approximately parallel to a ground layer. In an embodiment, the ground layer is a region of in situ ground material having favourable resistivity characteristics.

In an embodiment, ground material extracted from the borehole during drilling is retained for use as least a portion of the backfill ground material. In an embodiment, the borehole is filled with backfill ground material and one or more additives.

In an embodiment when used to expand an existing earthing system, total electrical resistance is the electrical resistance measured between each of an earthing electrode of the existing earthing system and the submerged portion of the drill string and the test electrode or electrodes.

Other embodiments of the present invention may be disclosed herein or may become apparent to the skilled person through the disclosure. These and other embodiments are considered to fall within the scope of the present invention.

DESCRIPTION OF FIGURES

Embodiments of the present invention will now be described in relation to figures, wherein.

DEFINITIONS

As used herein, the term 'earthing electrode' should be understood to refer to metal conductors (or a combination of metal conductor types), which are buried or enclosed within ground material to provide an earth for an electrical system and can include rods or pipes driven into the ground, cables, stakes and wires or wire loops.

As used herein, the term 'ground material' should be understood to be the soil, dirt, gravel, rocks, agglomerate, plant matter and other material within the ground in the region.

DETAILED DESCRIPTION OF PREFERRED EMBODIMENTS

Figure 3:
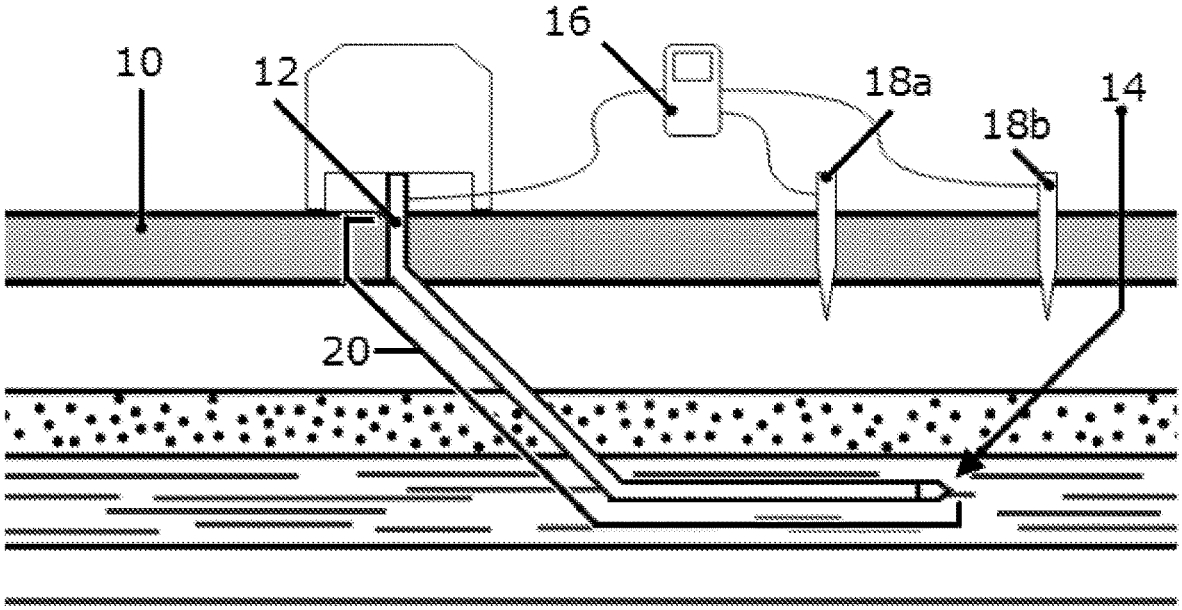
FIG. 3 depicts an embodiment of the present invention.

In a first aspect and with reference to FIG. 3, the invention provides a method of installing an electrical earthing system in a region of ground, comprising the steps of:

(1) determining a borehole site in the region of ground 10;

(2) providing a drill string 12 comprised of a conductive material and having a drill bit 14 at an end thereof, and electrically connecting the drill string to an earth test terminal of a resistance testing apparatus 16;

(3) electrically connecting a test electrode or electrodes 18*a,b* to a remaining terminal or terminals of the resistance testing apparatus 16 and placing the test electrode or electrodes in or on the ground 10 within an area around the borehole;

(4) drilling the borehole using the drill string and attached drill bit;

(5) periodically, or continuously, measuring and recording a total electrical resistance using the resistance testing apparatus and adjusting the drill string to reduce the total electrical resistance towards a target total electrical resistance;

(6) removing the drill rod from the borehole and disconnecting the drill string from the resistance testing apparatus;

(7) installing an earthing electrode within the borehole; and (8) backfilling the borehole with ground material;

wherein the total electrical resistance is electrical resistance measured between a submerged portion 20 of the drill string and the test electrode or electrodes, and is not simply the electrical resistance between the drill bit and the test electrode or electrodes. The test electrode or electrodes 18*a,b* may be vertical test electrodes (for example, the test electrodes 18*a,b* depicted in FIG. 3). Alternatively, the test electrode(s) may be horizontally-lain electrode(s), ball-shaped electrode(s), electrode spike(s) or any other test electrode design known in the art.

In an embodiment, the earthing electrode may be installed by attaching it to the end of the retracted drill string 12, and using the drill string to push the earthing electrode along the borehole. Such an embodiment is of use when the earthing electrode is a flexible cable as the drill string 12 can be used to guide the cable along the borehole length.

The skilled person will appreciate that the target total electrical resistance is at least partially determined based upon the properties of the electrical system or network for which the electrical earthing system of the present invention is being installed. In general, a lower total electrical resistance is more preferable to a higher total electrical resistance, and it is an object of at least one embodiment of the method of the present invention to provide a means of achieving a total electrical resistance that is substantially lower than that of an earth electrode that has been installed using a prior at method.

In an embodiment, the target total electrical resistance is preferably less than 100 ohms (Ω). More preferably, the target total electrical resistance is less than 50 Ω, less than 25 Ω, less than 10 Ω, or less than 5 Ω. The skilled person will appreciate that the efficiency of an earth electrode improves as total electrical resistance drops, and in a most preferred case wherein conditions are optimal, the target total electrical resistance may be less than 1 Ω, or even less than 0.5 Ω. However, the skilled person will further appreciate that the minimum achievable total electrical resistance will depend upon the characteristics of the ground.

Figure 1:
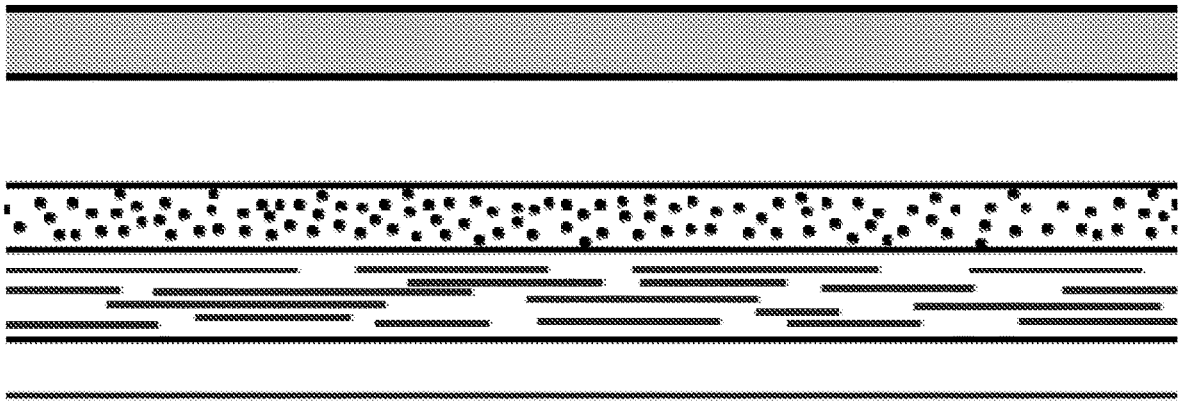
FIG. 1 depicts a cross-sectional view of the ground into which an electrode of a earthing system is to be installed, showing the different ground layers or strata layers.
Figure 2A:
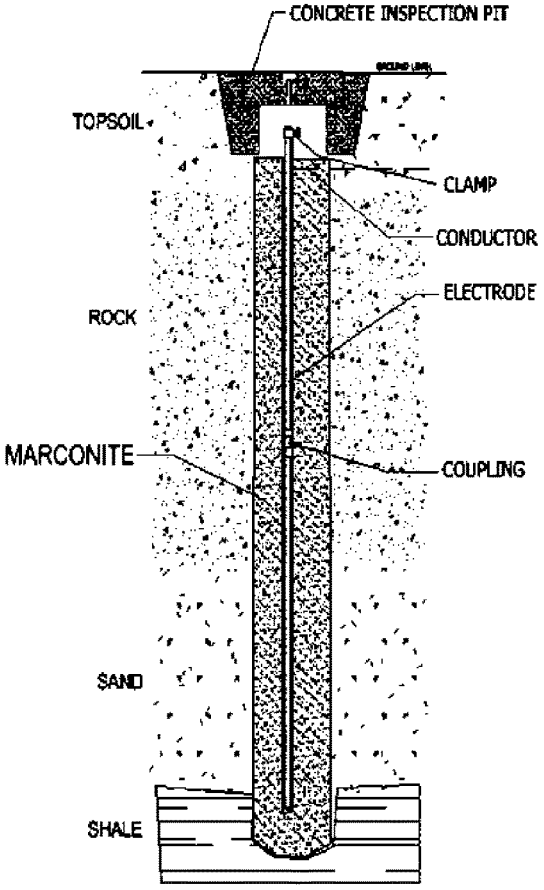
FIGS. 2A & 2B depict an electrode of a prior art earthing systems
Figure 2B:
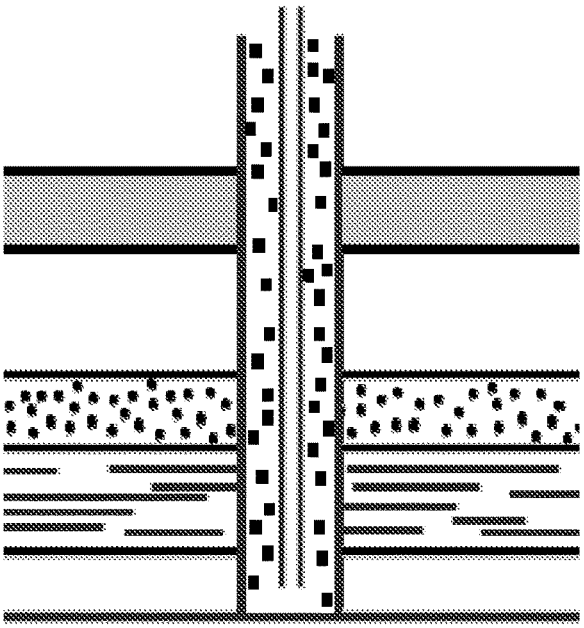

With return reference to FIG. 1, as the borehole is drilled, it may pass into ground material having different resistivity characteristics, which will affect the overall performance of an earth electrode that is ultimately installed therein. Therefore, an embodiment of the present invention may be advantageous by testing the total electrical resistance of the earthing system during the drilling process, which is achieved by using the entire submerged portion 20 of the drill string 12 as the earth test electrode for testing with the resistance testing apparatus 16. This may enable the effect of a particular ground layer on the total electrical resistance to be identified and assessed during drilling. The skilled person will appreciate that this is different to the prior art methods wherein resistivity is measured solely between the prior art drill bit and testing electrodes, rather than the entire prior art drill string.

The total electrical resistance of the submerged portion 20 of the drill string 12 will decrease at a particular rate as the borehole length is increased. The rate of reduction in total electrical resistance ($\Delta R_T$) is also dependent upon the resistivity characteristics of the ground material that the drill bit is currently drilling into. By periodically or continuously measuring the total electrical resistance, an operator can identify when the drill bit is within a ground layer having favourable resistivity characteristics, as the $\Delta R_T$ will increase. Conversely, the drill bit entering a ground layer with less favourable resistivity characteristics will be apparent as a reduction in $\Delta R_T$.

The present invention may also enable a particular borehole to be adjusted, realigned abandoned, terminated, or otherwise reassessed if ground material with particularly unfavourable resistivity characteristics is encountered. For example, ground material with particularly unfavourable resistivity characteristics may mean that extending the borehole in a particular direction will provide limited reduction in total electrical resistance, i.e. the $\Delta R_T$ is lowered. In such a scenario, the drill string may be re-angled, relocated or otherwise adjusted such that the drilled borehole circumvents the ground material having unfavourable characteristics, or alternatively may drill therethrough to an adjacent ground layer having more favourable resistivity characteristics. Alternatively, upon encountering a ground layer having more favourable resistivity characteristics (i.e. noting that $\Delta R_T$ is increased), the drill string or drill bit may be adjusted such that the borehole extends further into the ground layer.

Borehole Site Determination

In an embodiment, the step of determining the borehole site comprises:

(1) using the resistance testing apparatus 16 to test ground electrical resistance at a plurality of sites within the region;

(2) using the ground electrical resistance to identify, from the plurality of sites within the region, at least one qualifying site; and (3) selecting the borehole site from the at least one qualifying site or sites.

In an embodiment, the qualifying site(s) is, or are, sites having favourable resistivity characteristics relative to the other site(s) within the region. This may be inferred, wherein a low ground electrical resistance value is considered indicative of favourable characteristics. Alternatively, soil resistivity may be more qualitatively calculated from the measured ground electrical resistance through one of the methods known in the art. The skilled person will appreciate that what would be considered favourable resistivity characteristics is highly dependent upon the local geographic and geological properties of the region, such as location, expected ground material types, as well as climate (humidity, rainfall, temperature, etc.), soil salt content and other factors. In other words, what may be favourable in one region characterised by soils having high resistivity may be considered less favourable in another that is characterised by an abundance of soils having a low resistivity.

In a further embodiment, the borehole site is selected as the site having the most favourable resistivity characteristics of the plurality of sites.

In an embodiment, ground material extracted from the borehole during drilling may be retained for use as backfill ground material, particularly if the retained ground material is determined to have favourable resistivity characteristics. In an embodiment, one or more additives such as soil stabilisers, wetting agents, or salts, may be added to the backfill ground material in order to improve the characteristics thereof.

Directional Drilling

In an embodiment, the drill bit 14 is a directional drill bit, and during Step 4, a direction of the drill bit is adjustable such that the borehole is able to be drilled to comprise consecutive portions thereof extending non-parallel to one another. In a further embodiment, the borehole is drilled so as to extend through a ground layer at an angle between −45° and +45° relative to horizontal (0°) for at least a portion of a length thereof. As the skilled person may appreciate, ground layers tend to approximately extend in a planar fashion, although thickness may vary. The plane of a ground layer is also likely to be horizontal, or at least inclined less than 45° on average. It is therefore advantageous to provide a means of digging a borehole for receiving the earthing electrode that extends either horizontally, substantially parallel to a ground layer, or otherwise at an angle between $-45^0$ and +45° relative to horizontal.

Figure 4:
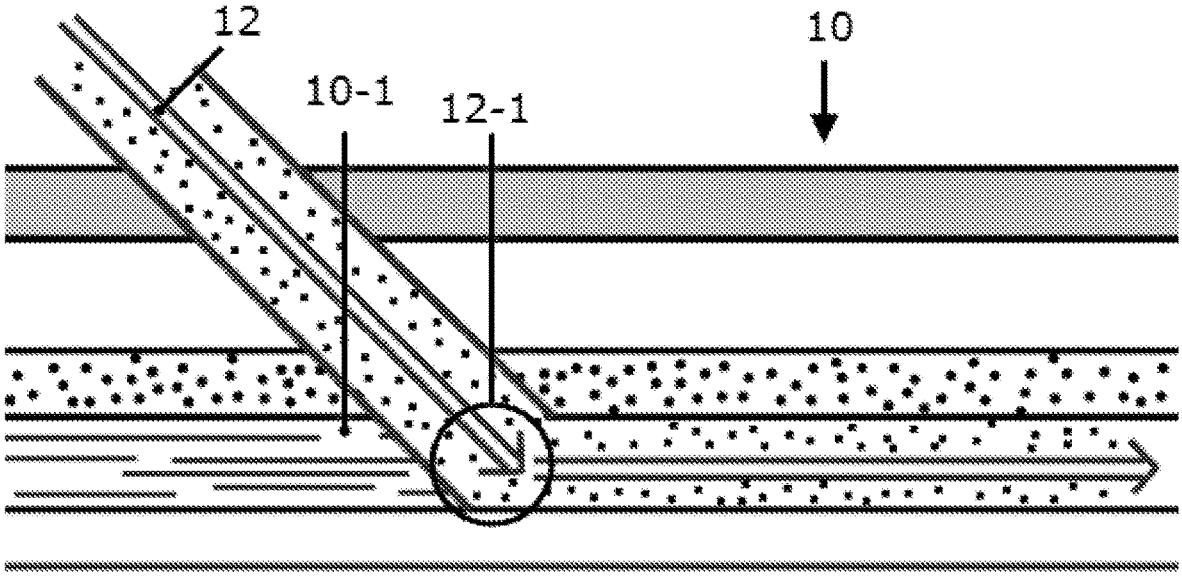
FIG. 4 depicts an embodiment of the present invention having a directional drill bit installed on the drill string.

In an embodiment wherein the drill bit 14 is a directional drill bit, the borehole is drilled such that at least a portion of a length of the borehole extends approximately parallel to a ground layer. In a further embodiment, the ground layer is a region of in situ ground material having favourable resistivity characteristics. One such embodiment is depicted in FIG. 4, showing drill string 12 extending into the ground 10 and ultimately into favourable ground layer 10-1. With the periodic or continuous monitoring of the total electrical resistance by the resistance testing apparatus 16, a favourable ground layer 10-1 may be identified as a point when the rate of reduction in resistance (ΔR) increases in magnitude, labelled on FIG. 4 as point 12-1. When the drill bit of the drill string 12 reaches point 12-1 and the increase in ΔR is identified, the drill bit 14 can be angled such that the borehole will subsequently extend parallel to favourable ground layer 10-1.

Figure 5:
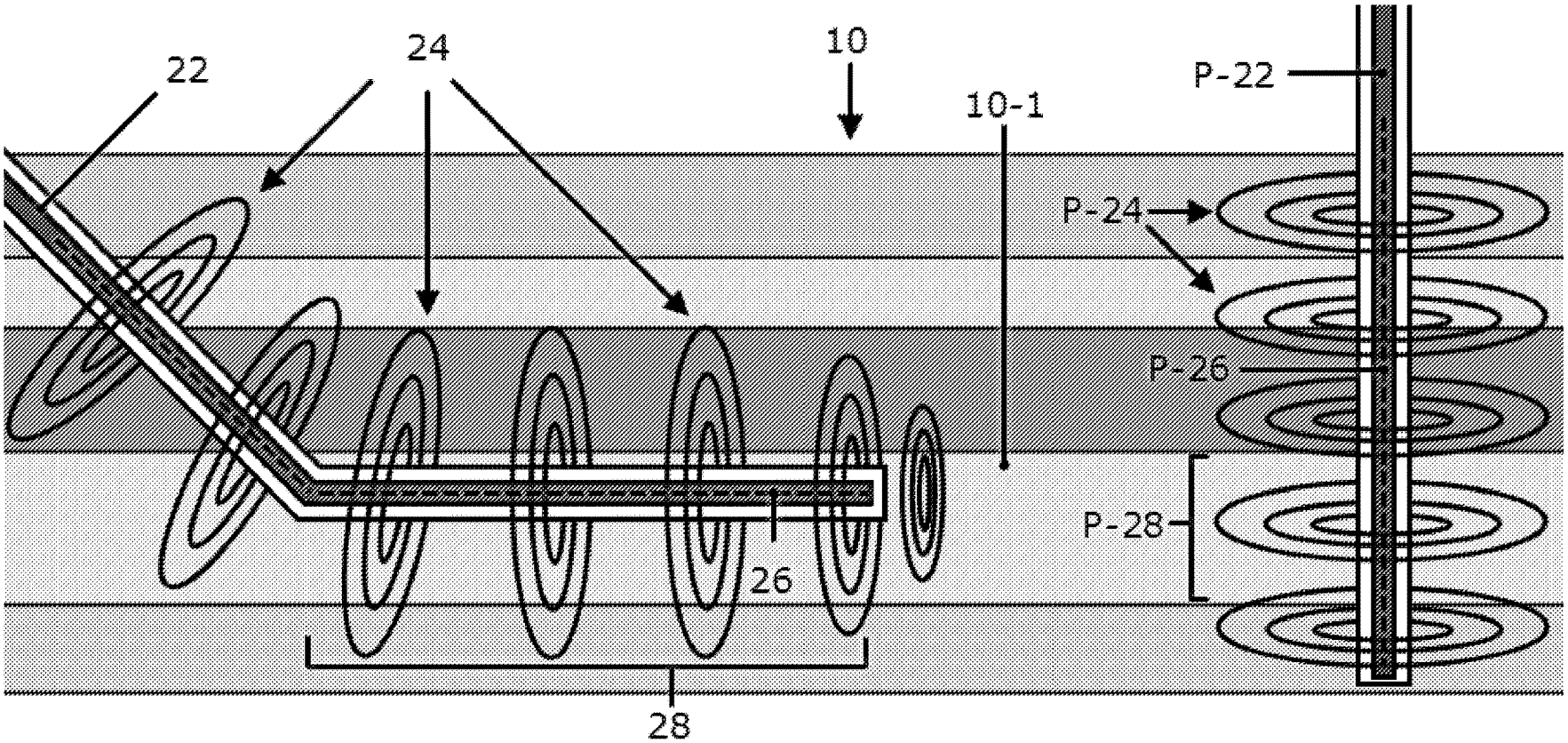
FIG. 5 is a comparative diagram of earth electrodes installed through a method of the present invention and through a prior art method.
Figure 12:
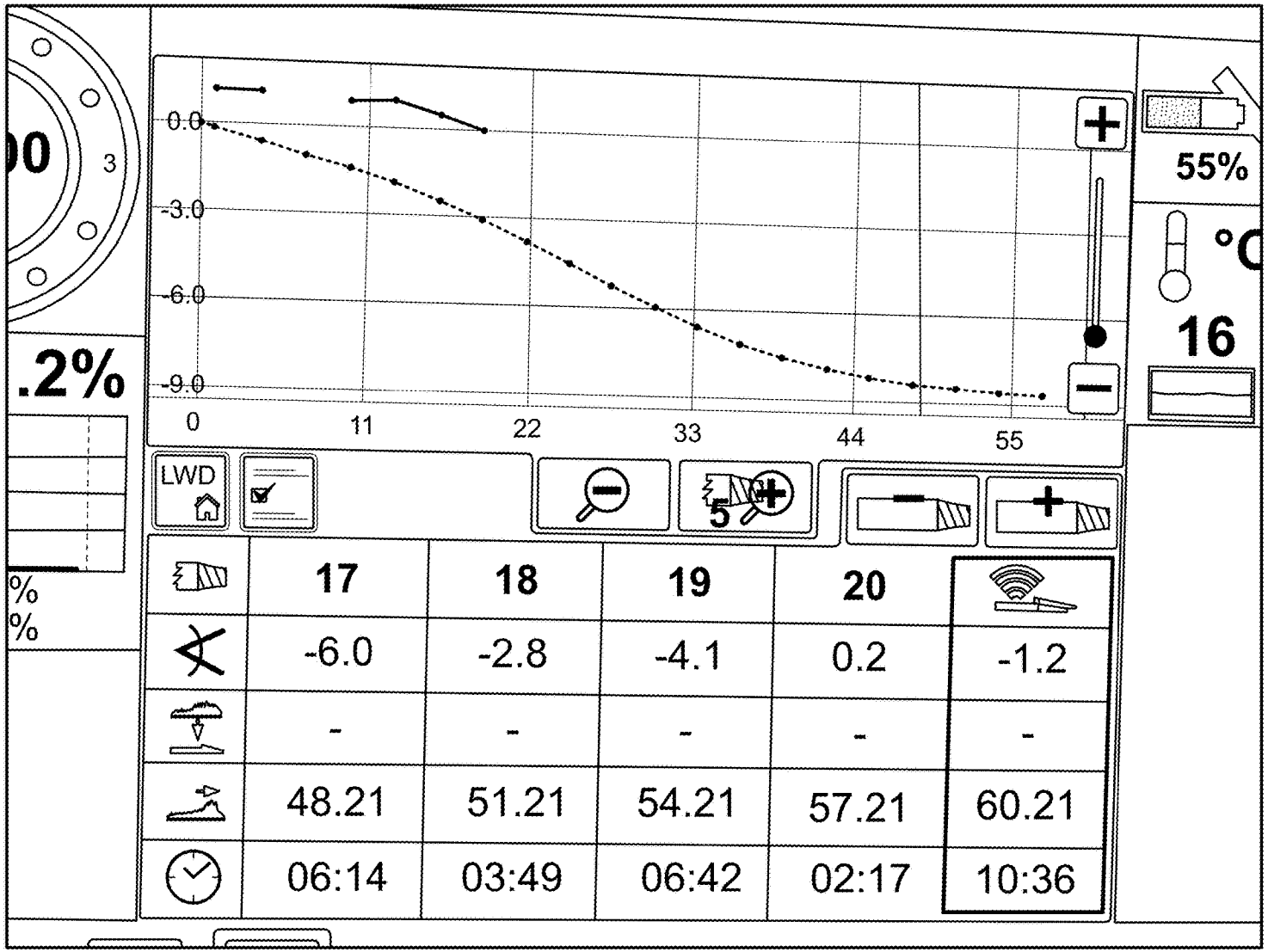
FIG. 12 shows a photograph of the progressive measurements obtained from the resistivity tester of FIG. 10.
Figure 13:
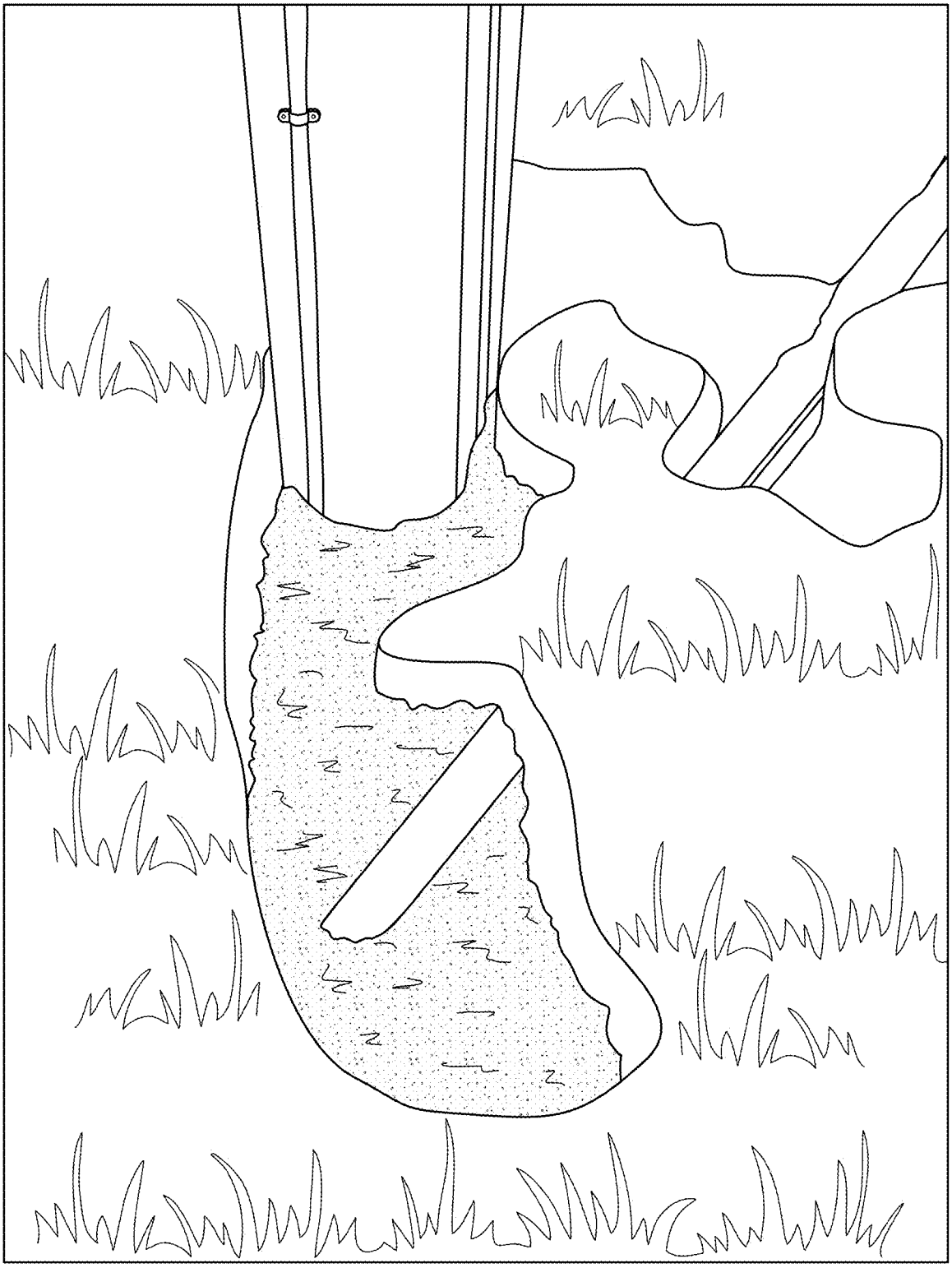
FIG. 13 shows a photograph of the drilling mud from the borehole.
Figure 14:
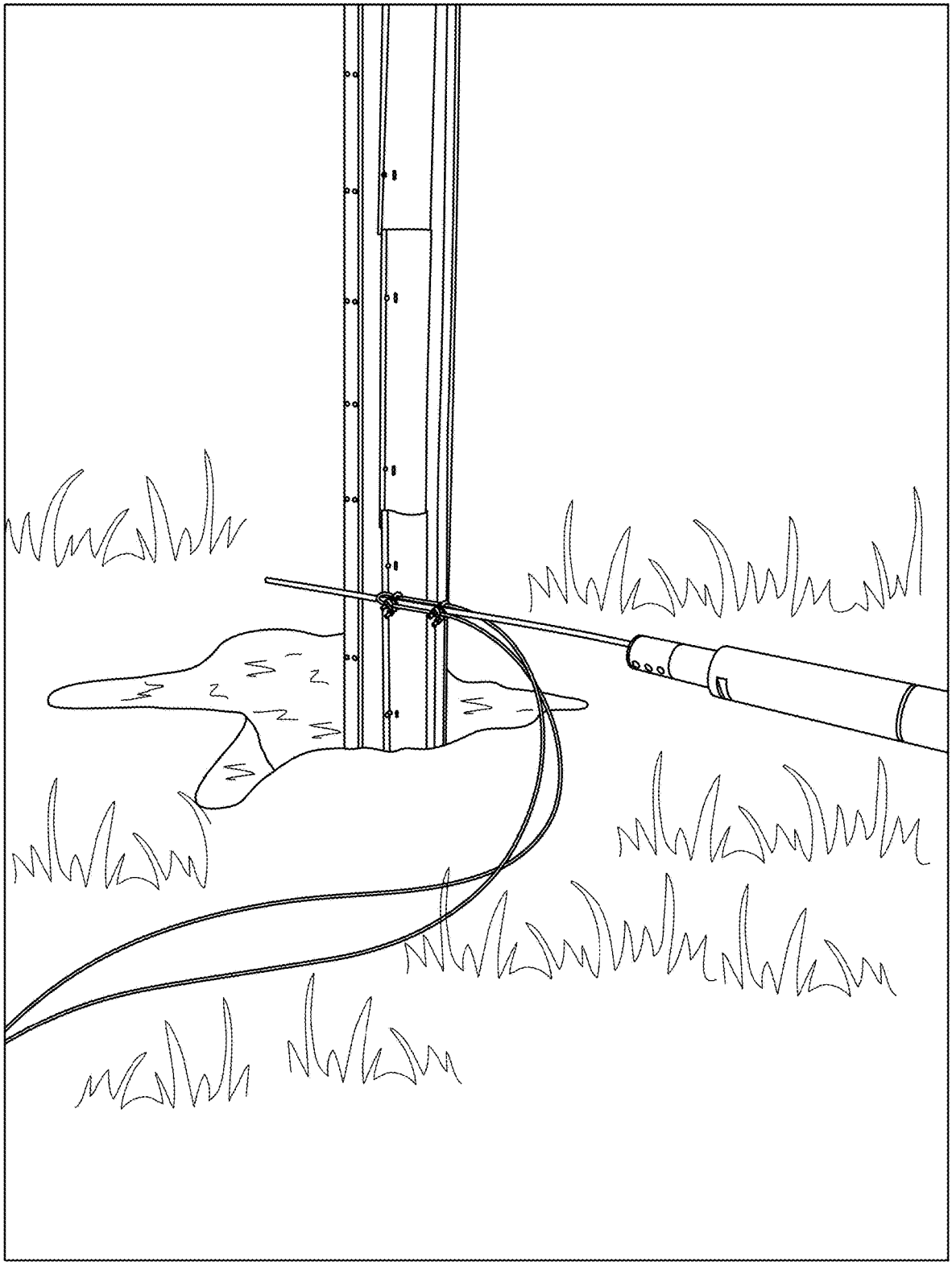
FIG. 14 shows a photograph of the drill rod (retracted from the borehole) and having an earth conductor (in the form of an earthing wire) with a loop at the bottom attached to the end of the drill rod for installation into the borehole.
Figure 15:
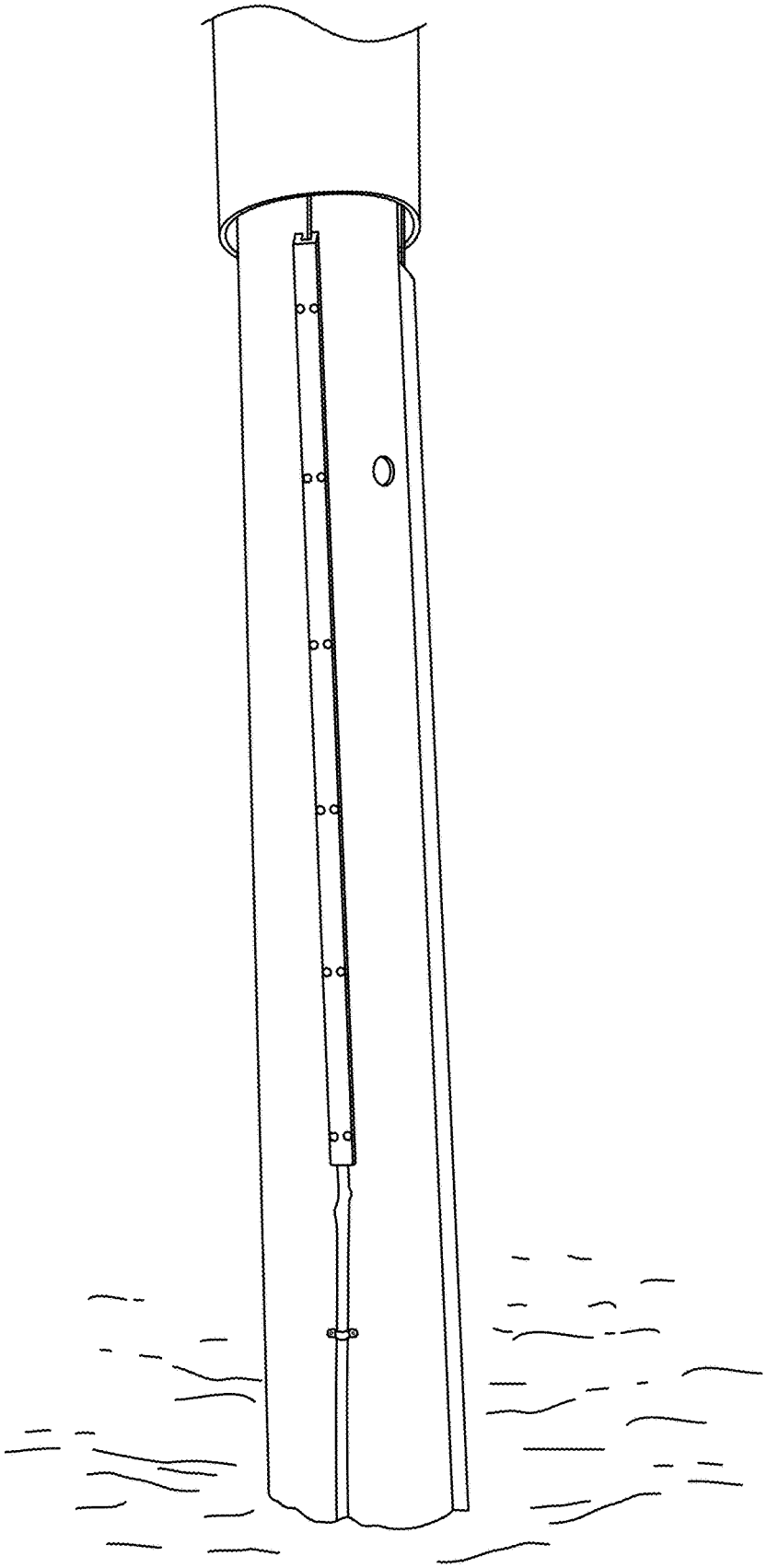
FIG. 15 shows a photograph of an electrical pole with a completed earth grounding system installed by the method of the present invention.

It is considered beneficial to provide a means of optimising ΔR, as an increase in ΔR means that a target total electrical resistance may be reached more efficiently and with a borehole of reduced length, leading to less material required to subsequently form the earth electrode. An example of this may be seen in the photograph of FIG. 12, which depicts a recorded total electrical resistance over time. A first change in ΔR can be seen in the upper left of the graph shown in the photograph, where the magnitude of ΔR has increased due to the drill string 12 passing into a favourable ground layer 10-1. A second change in ΔR is visible in the bottom right, with a decrease in magnitude thereof. This may indicate that the drill string has exited the favourable ground layer 10-1, or drilling has slowed due to a maximum drill string length being approached. With reference to FIG. 5, it is considered that an earth electrode 22 will emit electrical current in all directions, forming a radiating emission pattern 24. FIG. 5 depicts a series of concentric circles to indicate how the emission pattern changes as the direction of the borehole and installed earth electrode 22 does. The skilled person will appreciate that the elements and concentric circles depicted in FIG. 5 are for explanatory purposes only and therefore are not necessarily to scale, and that the concentric circles represent the "wavefront" of emitted electrical current. In other words, the emitted electrical current is travelling substantially perpendicular to the concentric circles of the radiating emission pattern 24. The skilled person will further appreciate that the earth electrode 22 acts as the 'axis' 26 of the emission patterns 24. Without limiting the scope of the invention through theory, it is considered that aligning at least a portion 28 of the axis 26 of the emission patterns 24 to be within and substantially parallel to favourable ground layer 10-1 may promote efficiency by increasing a surface area of the earth electrode 22 (i.e. where the emission patterns 24 radiate outwards from) exposed to the ground material of the favourable ground layer 10-1. As such, electricity can be emitted into, and propagate through, the favourable ground layer 10-1 with greater ease, reducing total electrical resistance.

This may be contrast against a traditional prior art earth electrode P-22 extending substantially vertically, also depicted in FIG. 5. The prior art emission patterns P-24 are such that the electrical current is emitted in all horizontal directions, with the related axis P-26 extending substantially vertical—and thus perpendicular to the favourable ground layer 10-1. The portion P-28 of the prior art electrode P-22 that is located within the favourable ground layer 10-1 is substantially smaller than that of the electrode 22 installed using an embodiment of the method of the present invention. While the other layers of the ground 10 may also conduct electricity, they may be more resistant to electrical current flow than the favourable ground layer 10-1, and so portions of an earth electrode 22, P-22 within such a ground layer operate with less efficiency than the portion 28 within the favourable ground layer 10-1.

Through the method of the present invention, by continuously or periodically monitoring the total electrical resistance of the submerged portion of the drill string 12, the user is able to identify an optimum ground layer 10-1 and ensure that the borehole is drilled such that a greater proportion of the earth electrode 22 is installed within said optimum ground layer 10-1.

TABLE 1

| | Present Method | | | Prior Art Method | | | |
|---|---|---|---|---|---|---|---|
| Site | Elec. L (m) | T.E.R. (Ω) | Spc. R (Ω/m) | Elec. L (m) | T.E.R. (Ω) | Spc. R (Ω/m) | ΔSpc. R (%) |
| 01 | 63.00 | 3.00 | 0.048 | 26.00 | 26.00 | 1.00 | 95% dec. |
| 02 | 25.50 | 5.60 | 0.220 | 26.00 | 20.00 | 0.77 | 71% dec. |
| 03 | 21.00 | 4.00 | 0.190 | 26.00 | 26.00 | 1.00 | 81% dec. |
| 04 | 33.00 | 1.10 | 0.033 | 26.00 | 146.00 | 5.62 | 99% dec. |
| 05 | 69.00 | 3.30 | 0.048 | 26.00 | 25.00 | 0.96 | 95% dec. |
| 06 | 32.00 | 2.40 | 0.075 | 26.00 | 27.00 | 1.04 | 93% dec. |
| 07 | 22.00 | 1.80 | 0.082 | 26.00 | 12.80 | 0.49 | 83% dec. |
| 08 | 27.00 | 2.80 | 0.104 | 22.00 | 13.00 | 0.59 | 82% dec. |
| 09 | 10.00 | 1.30 | 0.130 | 26.00 | 12.00 | 0.46 | 72% dec. |
| 10 | 45.00 | 3.50 | 0.078 | 26.00 | 17.40 | 0.67 | 88% dec. |
| 11 | 45.00 | 3.60 | 0.080 | 26.00 | 150.00 | 5.77 | 99% dec. |
| 12 | 37.00 | 9.90 | 0.268 | 66.00 | 54.00 | 0.82 | 67% dec. |
| 13 | 42.00 | 0.76 | 0.018 | 26.00 | 3.70 | 0.14 | 87% dec. |
| 14 | 22.00 | 21.80 | 0.991 | 16.00 | 92.00 | 5.75 | 83% dec. |
| 15 | 94.00 | 7.80 | 0.083 | 138.00 | 23.00 | 0.17 | 50% dec. |
| 16 | 94.00 | 7.82 | 0.083 | 150.00 | 28.00 | 0.19 | 55% dec. |
| 17 | 33.00 | 1.10 | 0.033 | 36.00 | 13.90 | 0.39 | 91% dec. |
| 18 | 47.00 | 1.70 | 0.036 | 36.00 | 13.50 | 0.38 | 90% dec. |
| 19 | 39.00 | 2.60 | 0.067 | 36.00 | 13.26 | 0.37 | 82% dec. |
| 20 | 19.00 | 1.52 | 0.080 | 26.00 | 32.00 | 1.23 | 94% dec. |
| 21 | 20.00 | 0.64 | 0.032 | 26.00 | 38.00 | 1.46 | 98% dec. |
| 22 | 27.00 | 2.85 | 0.106 | 26.00 | 14.00 | 0.54 | 80% dec. |

Table 1 above records the electrode length (in metres), the recorded total electrical resistance of the installed electrode (in Ohms), and the specific resistance (in Ohms per metre) for both an electrode installed using an embodiment of the method of the present invention, and an electrode installed using the conventional prior art method. The final column records the percentage reduction in specific resistance between the prior art method and an embodiment of the present method. As Table 1 illustrates, a substantially lower total electrical resistance of the electrode is able to be achieved using the method of the present invention. Additionally, the method of the present invention enables usage of an increased electrode length where it may be beneficial, such as if even the most favourable ground layers suffer from poor electrical conductivity. In contrast, the prior art method's electrode length is limited by how deep the electrode borehole is able to be dug, and what deep rock layers are present which may inhibit drilling.

Finally, the specific resistance—the resistance of any particular, specific portion of the installed electrode—is substantially lower for electrodes installed through the present method compared to the prior art 'vertical' method. It is considered that achieving a minimal specific resistance enables an electrode to operate at heavily increased efficiency. A minimised specific resistance means that any given surface area portion of the electrode 22 is able to emit electrical current into the ground at a higher rate. As electrode length is also partially determined by the amount of electrical current that needs to be grounded, improving specific resistance of the installed electrode enables an electrode to earth current at a greater rate than a comparative electrode of the same length but greater specific resistance—or alternatively, the same rate of current earthing can be achieved by an earth electrode of smaller length than the comparator. With reference to Table 2, the decrease in specific resistance is significant—indeed, surprisingly so. In some embodiments of the present invention, the method may provide at least a 50% decrease in specific resistance compared to the prior art method. Some embodiments may provide at least a 60% decrease, at least a 70% decrease, at least an 80% decrease or at least a 90% decrease in specific resistance.

In an embodiment wherein the drill bit 14 is a directional drill bit, the borehole is drilled such that at least a portion of a length of the borehole extends approximately parallel to an angle of inclination of a geomagnetic field of the region. It has been found that, particularly when an earth electrode is of a substantial length and all else being equal, there is a synergistic improvement in earth electrode performance when said earth electrode is approximately aligned with the local geomagnetic field.

TABLE 2

| Site | Spc. R (Ω/m) | Avg Angle (%) | Avg Angle (deg) |
|---|---|---|---|
| 01 | 0.048 | 19% | 10.76 |
| 02 | 0.220 | 1% | 0.57 |
| 03 | 0.190 | 12% | 6.84 |
| 04 | 0.033 | 19% | 10.76 |
| 05 | 0.048 | 3% | 1.72 |
| 06 | 0.075 | 3% | 1.72 |
| 07 | 0.082 | 2% | 1.15 |
| 08 | 0.104 | 18% | 10.20 |
| 09 | 0.130 | 1% | 0.57 |
| 10 | 0.078 | 15% | 8.53 |
| 11 | 0.080 | 19% | 10.76 |
| 12 | 0.268 | 15% | 8.53 |
| 13 | 0.018 | 10% | 5.71 |
| 14 | 0.991 | 14% | 7.97 |
| 15 | 0.083 | 12% | 6.84 |
| 16 | 0.083 | 6% | 3.43 |
| 17 | 0.033 | 2% | 1.15 |
| 18 | 0.036 | 2% | 1.15 |
| 19 | 0.067 | 3% | 1.72 |
| 20 | 0.080 | 19% | 10.76 |
| 21 | 0.032 | 18% | 10.20 |
| 22 | 0.106 | 18% | 10.20 |

Figure 6:
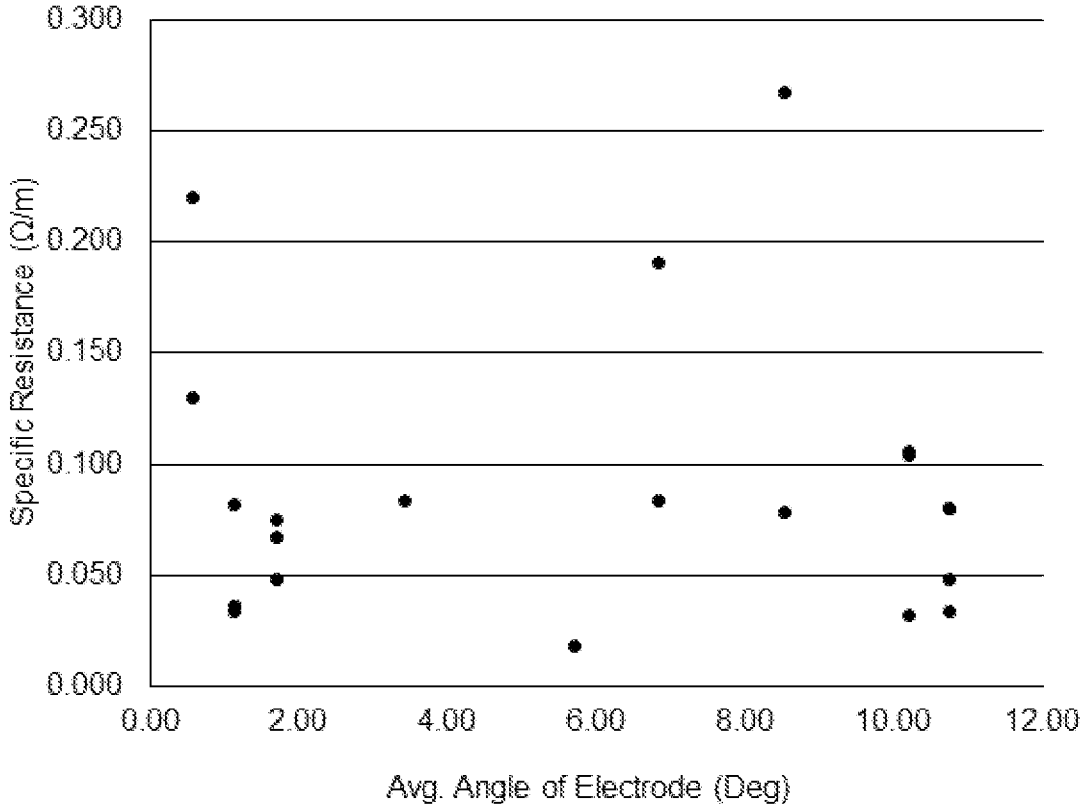
FIG. 6 is a graph of specific resistance vs. angle of inclination.

Table 2 above provides the average angle of the "horizontal" portion, or the portion aligned to the favourable ground layer 10-1, of the installed electrodes from Table 1. Each test site had an earth electrode installed in a borehole drilled with a directional drill bit, with the direction of the borehole adjusted to optimise specific resistance. FIG. 6 depicts specific resistance plotted against the average angle of installation for the earth electrodes, with the value from Site 14 excluded as an outlier. As can be seen, there are two distinct clusters—one where the angle of installation is close to horizontal, and the second where the angle of installation is between −10° and −11°, and a range of values in between. As Table 2 and the graph of FIG. 6 depict, the "horizontal portion" of the borehole are not necessarily exactly horizontal—rather, 'horizontal' as used herein refers to substantially aligning to the typically—substantially—horizontal ground layers, as opposed to a prior art electrode P-22 that is substantially vertical.

Providing Earthing in Problematic Locations

Electrical systems require earthing. However, in some situations an earthing system may need to be installed in a built-up area, near a road, bridge or tunnel, in national parks, farms, or other areas where trenching would cause unacceptable disruptions, when a body of water is present or an upper ground layer is difficult to dig, or otherwise when trying to expand an already-present earthing system. In such a situation, an embodiment of the present invention may be further advantageous in that no trenching is required. The directional drill bit may enable the borehole to be extended under any existing infrastructure, difficult ground material, or other potential obstacles (such as trees, nesting sites, boulders, etc.) without requiring their disturbance. This will allow the efficient installation of suitable earthing systems in a variety of situations wherein it is too cost-, time-, or labour-intensive or otherwise difficult or impossible to install an earthing system through a prior art method.

Figure 7:
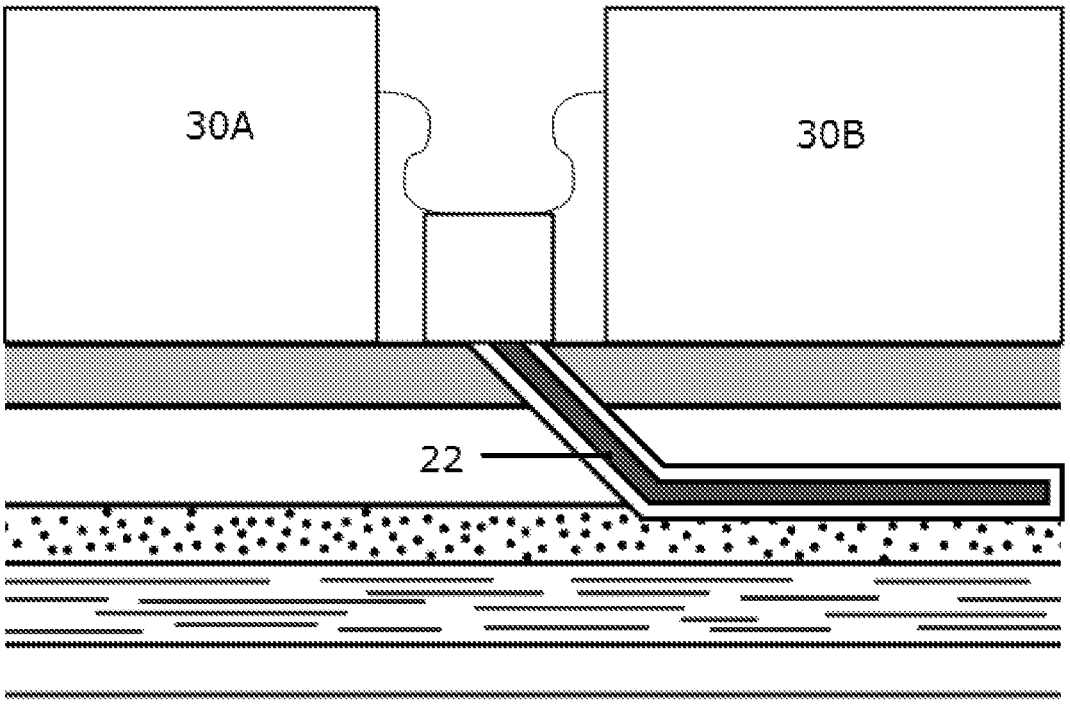
FIG. 7 is a diagram of an electrode installed in an area of heavy infrastructure.

With reference to FIG. 7, there may also not be enough exposed ground 10 to provide for installation of multiple vertical-type earthing electrodes. However, particularly in situations wherein one or more ground layers are difficult to dig through, multiple prior art vertical electrodes may need to be installed to achieve the desired total electrical resistance. In such a scenario, an embodiment of the present invention may also be advantageous in that the borehole can be dug under pre-existing infrastructure or other surface features (such as example buildings 30A & 30B), enabling installation of sufficient length of earthing electrode 22 to achieve a target total electrical resistance where multiple vertical electrodes are impractical or impossible. See also the photographs of FIGS. 10-15, depicting installation of an earthing electrode using an embodiment of the method of the present invention without disturbing an already-present power pole. In particular, FIGS. 10 & 13-15 depict the borehole being dug, drill mud being extracted, the earthing electrode being installed and the final result, all without the power pole being disturbed.

Multiple Boreholes and Expansion of Existing Networks

Figure 8:
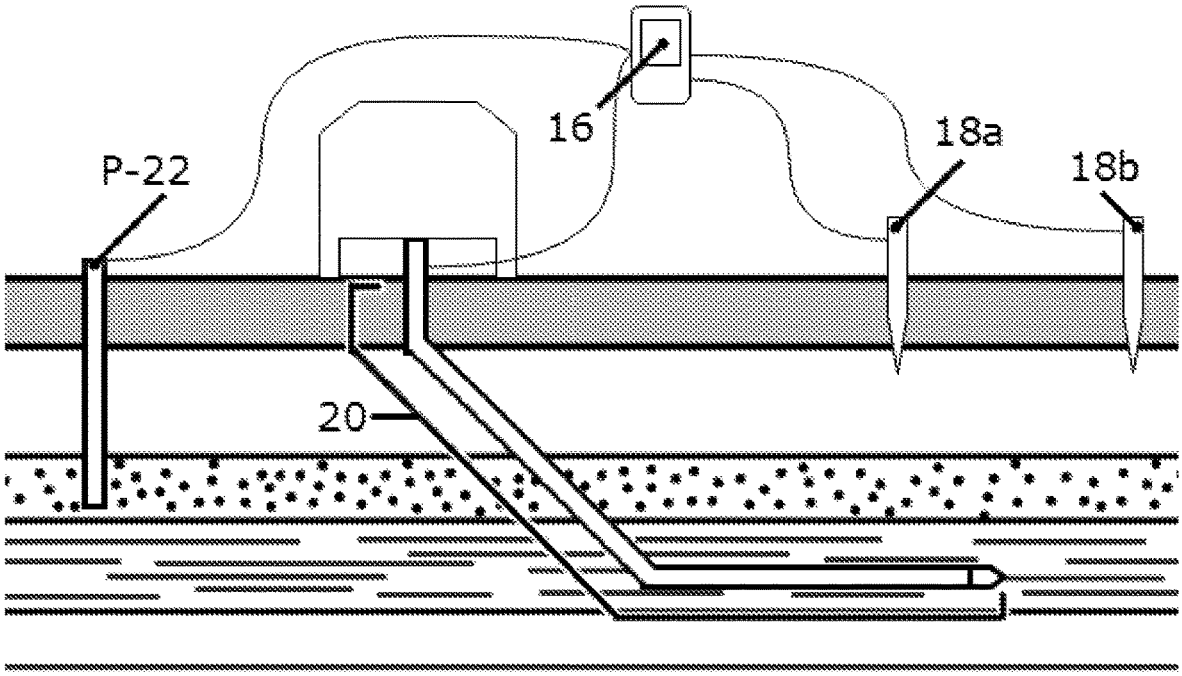
FIG. 8 depicts an embodiment of the present invention being used to expand an existing earthing system.

Existing earthing systems require maintenance, checking, replacement and occasionally extension or expansion, particularly if the associated electrical system or network being earthed has grown since installation or the resistivity characteristics of the ground have worsened (such as through soil leaching or contamination). An embodiment of the method may be able to be used to expand an existing earthing system. With reference to FIG. 8, when the method is used in such a manner, total electrical resistance may be determined as the electrical resistance measured between each of an earthing electrode of the existing earthing system P-22 and the submerged portion 20 of the drill string 12, and the test electrode or electrodes 18*a,b*.

Figure 9:
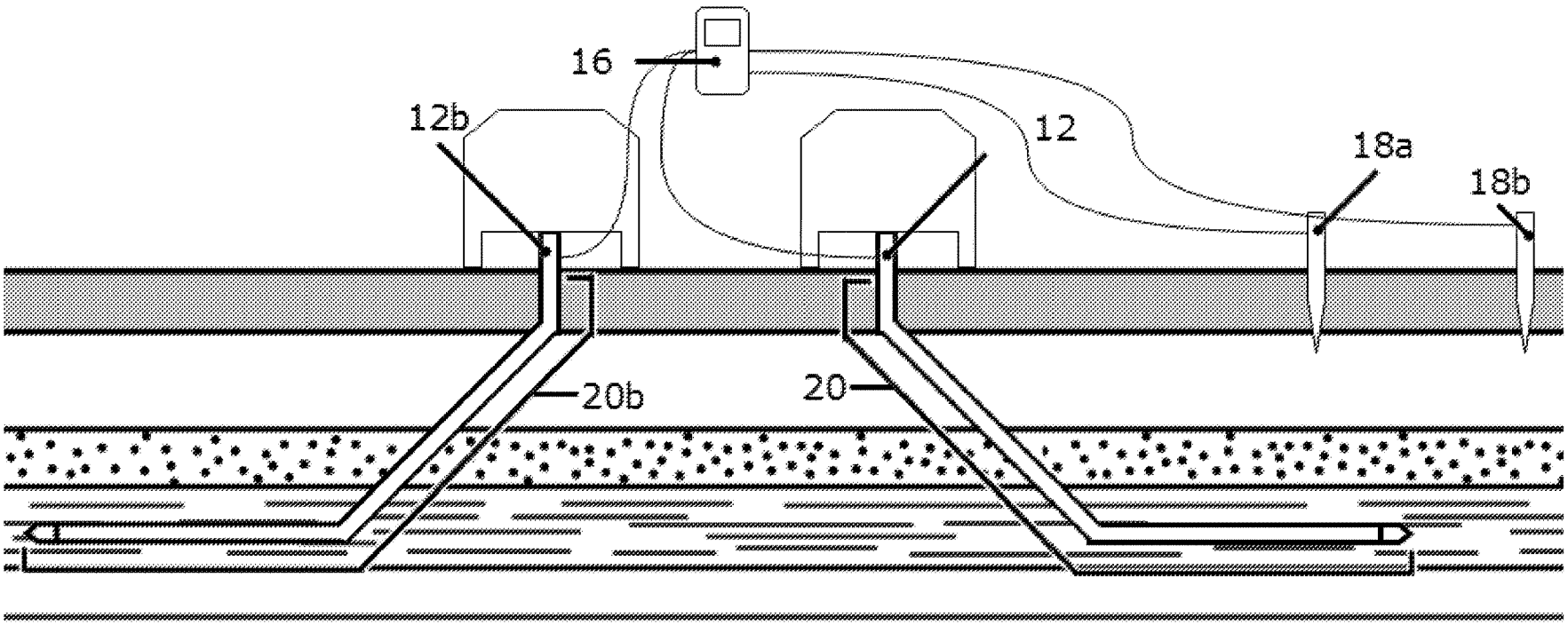
FIG. 9 depicts an embodiment of the present invention comprising multiple boreholes.
Figure 10:
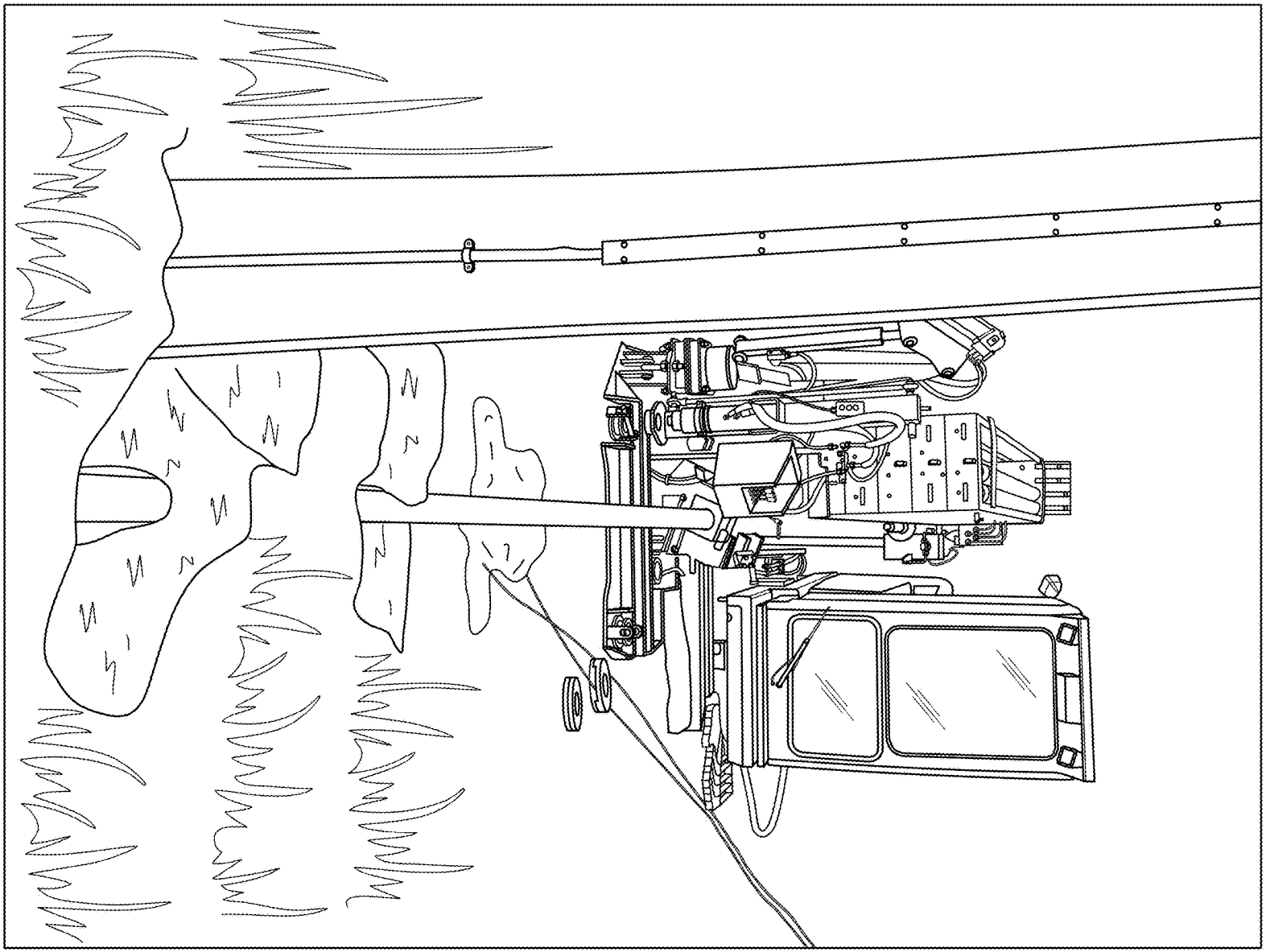
FIG. 10 shows a photograph of a directional drill apparatus digging a borehole in the ground.
Figure 11:
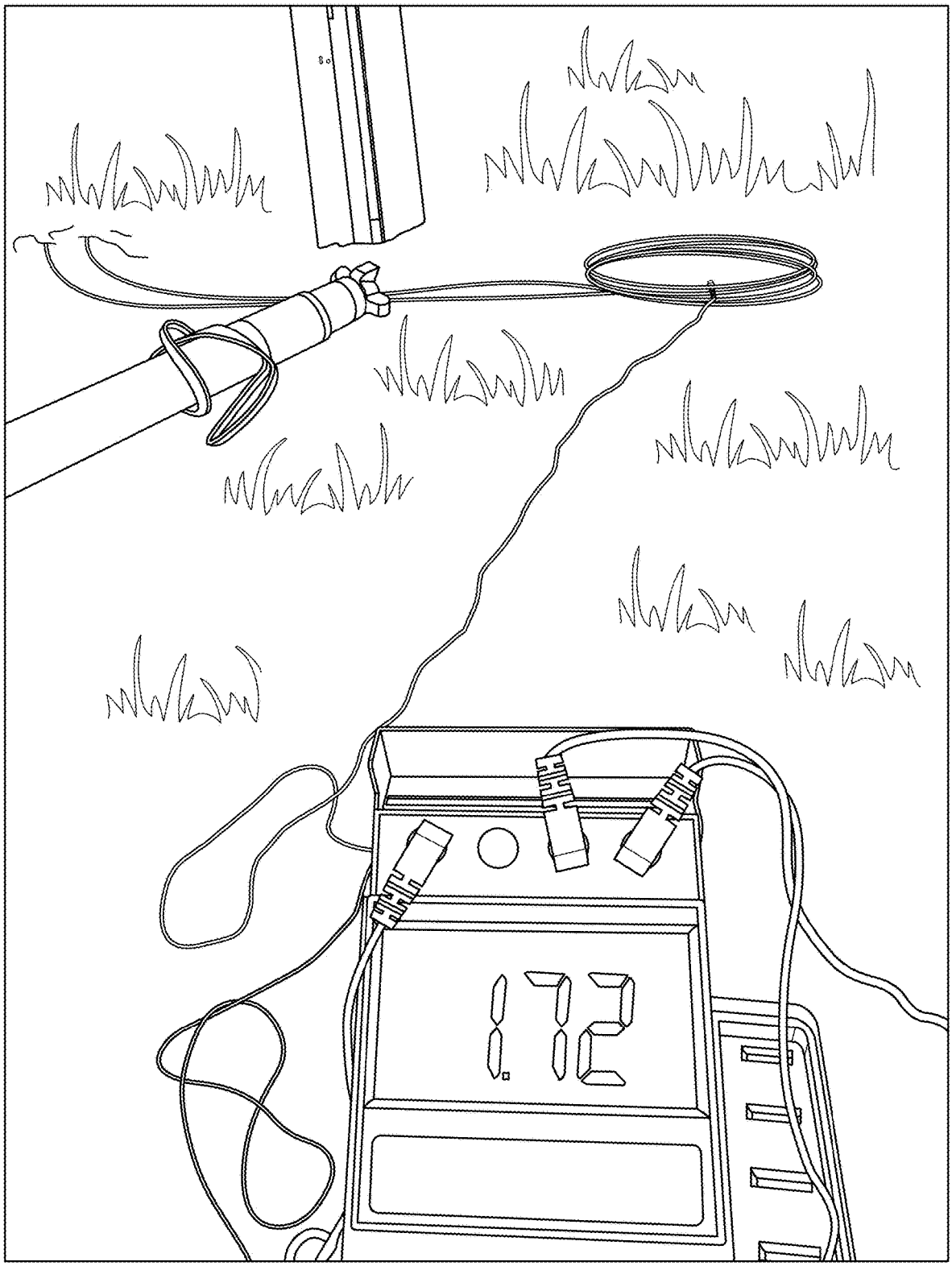
FIG. 11 shows a photograph of the resistivity tester used to measure the ground resistivity in accordance with Step 2 of the present invention.

The total electrical resistance measured between the submerged portion 20 of the drill string 12 and the test electrode or electrodes 18*a,b*, may not reach the target total electrical resistance. In some embodiments, it may be necessary to expand the electrical earthing system by installing further earth electrodes. In an embodiment and with reference to FIG. 9, if by step 6, the total electrical resistance does not reach the target total electrical resistance, steps 1-6 may be repeated to drill a further borehole in the region of ground for a further earthing electrode to be installed within the further borehole before being backfilled with ground material. In at least one embodiment wherein there is a further borehole being drilled, total electrical resistance is electrical resistance measured between each of a conductive element in the first borehole and a further conductive element in the further borehole and the test electrode or electrodes. This so that the total performance of the earthing system may be determined.

In an embodiment wherein Step 7 is not yet executed for the first borehole (i.e. a further borehole is being drilled either concurrently with the first borehole, or otherwise before the drill string 12 is removed from the first borehole) then the conductive element is the submerged portion 20 of the drill string 12, and the further conductive element is a submerged portion 20*b* of a further drill string 12*b*. This is the particular embodiment depicted in FIG. 9.

In an alternate embodiment wherein Step 7 is executed with regards to the first borehole, the conductive element is the earthing electrode installed within the electrode and the further conductive element is a submerged portion of the drill string within the further borehole.

While the invention has been described with reference to preferred embodiments above, it will be appreciated by those skilled in the art that it is not limited to those embodiments, but may be embodied in many other forms, variations and modifications other than those specifically described. The invention includes all such variation and modifications. The invention also includes all of the steps, features, components and/or devices referred to or indicated in the specification, individually or collectively and any and all combinations or any two or more of the steps or features.

In this specification, unless the context clearly indicates otherwise, the word "comprising" is not intended to have the exclusive meaning of the word such as "consisting only of", but rather has the non-exclusive meaning, in the sense of "including at least". The same applies, with corresponding grammatical changes, to other forms of the word such as "comprise", etc.

Other definitions for selected terms used herein may be found within the detailed description of the invention and apply throughout. Unless otherwise defined, all other scientific and technical terms used herein have the same meaning as commonly understood to one of ordinary skill in the art to which the invention belongs.

Any promises made in the present document should be understood to relate to some embodiments of the invention, and are not intended to be promises made about the invention in all embodiments. Where there are promises that are deemed to apply to all embodiments of the invention, the applicant/patentee reserves the right to later delete them from the description and they do not rely on these promises for the acceptance or subsequent grant of a patent in any country.

Having described preferred embodiments of the invention, it will be apparent to those skilled in the art to which this invention relates, that modifications and amendments to various features and items can be effected and yet still come within the general concept of the invention. It is to be understood that all such modifications and amendments are intended to be included within the scope of the present invention.

The invention claimed is:

1. A method of installing an electrical earthing system in a region of ground, comprising the steps of:

(I) determining a borehole site in the region of ground;

(II) providing a drill string comprised of a conductive material and having a drill bit at an end thereof, and electrically connecting the drill string to an earth test terminal of a resistance testing apparatus;

(III) electrically connecting a test electrode or electrodes to a remaining terminal or terminals of the resistance testing apparatus and placing the test electrode or electrodes in or on the ground within an area around a borehole;

(IV) drilling the borehole using the drill string;

(V) periodically or continuously measuring and recording a total electrical resistance using the resistance testing apparatus, and adjusting the drill string to reduce the total electrical resistance towards a target total electrical resistance;

(VI) removing the drill rod from the borehole and disconnecting the drill string from the resistance testing apparatus;

(VII) installing an earthing electrode within the borehole; and (VIII) backfilling the borehole with backfill ground material;

wherein the total electrical resistance is electrical resistance measured between a substantially entire length of the drill string that is submerged underground and the test electrode or electrodes.

2. The method of claim 1, wherein:

if, by step (VI), the total electrical resistance does not reach the target total electrical resistance, steps (I) through (IV) are repeated to drill a further borehole in the region of ground;

a further earthing electrode is installed within the further borehole, which is then backfilled with ground material;

the total electrical resistance is electrical resistance measured between:

(a) each of a conductive element in the borehole and a further conductive element in the further borehole; and (b) the test electrode or electrodes;

the conductive element is either the earthing electrode installed within the electrode or the submerged portion of the drill string, depending on if Step (VII) is executed for the borehole; and the further conductive element is either a submerged portion of the drill string within the further borehole, or a submerged portion of a further drill string, depending on if Step (VII) is executed for the borehole.

3. The method of claim 1, wherein the step of determining the borehole site comprises:

(I) using the resistance testing apparatus to test ground electrical resistance at a plurality of sites within the region;

(II) using the ground electrical resistance to identify, from the plurality of sites within the region, at least one qualifying site; and (III) selecting the borehole site from the at least one qualifying site or sites;

wherein the qualifying or sites are identified by having favourable resistivity characteristics relative to other sites of the plurality of sites.

4. The method of claim 3, wherein the borehole site is selected as the site having the most favourable resistivity characteristics of the plurality of sites.

5. The method of claim 1, wherein the drill bit is a directional drill bit; and during Step (IV), a direction of the drill bit is adjustable such that the borehole is able to be drilled to comprise consecutive portions thereof extending non-parallel to one another.

6. The method of claim 5, wherein the borehole extends through a ground layer at an angle between −45° and +45° relative to horizontal (0°) for at least a portion of a length thereof.

7. The method of claim 5, wherein the borehole is drilled such that at least a portion of a length of the borehole extends approximately parallel to a ground layer.

8. The method of claim 7, wherein the ground layer is a region of in situ ground material having favourable resistivity characteristics.

9. The method of a claim 1, wherein ground material extracted from the borehole during drilling is retained for use as least a portion of the backfill ground material.

10. The method of a claim 1, wherein the borehole is filled with the backfill ground material and one or more additives.

11. The method of a claim 1, when used to expand an existing earthing system, the total electrical resistance is the electrical resistance measured between:

(a) each of an earthing electrode of the existing earthing system and submerged portion of the drill string; and (b) the test electrode or electrodes.

12. A method of installing an electrical earthing system in a region of ground, comprising the steps of:

(I) determining a borehole site in the region of ground;

(II) providing a drill string comprised of a conductive material and having a directional drill bit at an end thereof, and electrically connecting the drill string to an earth test terminal of a resistance testing apparatus;

(III) electrically connecting a test electrode or electrodes to a remaining terminal or terminals of the resistance testing apparatus and placing the test electrode or electrodes in or on the ground within an area around a borehole;

(IV) drilling into the ground using the drill string to form the borehole;

(V) periodically or continuously measuring and recording a total electrical resistance using the resistance testing apparatus, and adjusting the drill string to reduce the total electrical resistance towards a target total electrical resistance;

(VI) identifying a ground layer having favourable resistivity characteristics;

(VII) adjusting the direction of the directional drill bit such that the borehole is formed within and substantially parallel to the identified ground layer;

(VIII) once the total electrical resistance is reduced to the target total electrical resistance, removing the drill rod from the borehole and disconnecting the drill string from the resistance testing apparatus;

(IX) installing an earthing electrode within the borehole; and (X) backfilling the borehole with backfill ground material;

wherein the total electrical resistance is electrical resistance measured between a substantially entire length of the drill string that is submerged underground and the test electrode or electrodes.

* * * * *